US005698388A

United States Patent [19]

Waki

[11] Patent Number: 5,698,388

[45] Date of Patent: Dec. 16, 1997

[54] SILVER HALIDE COLOR PHOTOGRAPHIC MATERIAL CONTAINING A STABILIZED HIGH SILVER CHLORIDE EMULSION

[75] Inventor: Kokichi Waki, Minami-ashigara, Japan

[73] Assignee: Fuji Photo Film Co., Ltd., Minami-ashigara, Japan

[21] Appl. No.: 670,638

[22] Filed: Jun. 26, 1996

Related U.S. Application Data

[62] Division of Ser. No. 638,526, Jan. 8, 1991, abandoned.

[30] Foreign Application Priority Data

Jan. 11, 1990 [JP] Japan ..... 2-3888

[51] Int. Cl.[6] ..... G03C 1/005; G03C 1/34

[52] U.S. Cl. ..... 430/569; 430/603; 430/607; 430/608; 430/611; 430/613; 430/614

[58] Field of Search ..... 430/569, 551, 430/603, 607, 608, 611, 613, 614

[56] References Cited

U.S. PATENT DOCUMENTS

| | | | |
|---|---|---|---|
| 2,394,198 | 2/1946 | Mueller | 430/607 |
| 4,078,937 | 3/1978 | Tani et al. . | |
| 4,713,322 | 12/1987 | Bryan et al. | 430/569 |
| 4,960,689 | 10/1990 | Nishikawa et al. | 430/603 |
| 5,001,042 | 3/1991 | Hasebe | 430/603 |
| 5,061,614 | 10/1991 | Takada et al. | 430/569 |

FOREIGN PATENT DOCUMENTS

| | | | |
|---|---|---|---|
| 350046 | 1/1990 | European Pat. Off. | 430/614 |

*Primary Examiner*—Thorl Chea

*Attorney, Agent, or Firm*—Burns, Doane, Swecker & Mathis

[57] ABSTRACT

There is disclosed a silver halide color photographic material comprising a silver halide emulsion of high-silver chloride emulsion wherein a thiosulfonic compound represented by formula (I) and a sulfinic acid compound represented by formula (II) are added in the step of the production of said emulsion followed by sulfur sensitization. The disclosure described provides a silver halide color photographic material less in fogging due to the lapse of time after preparation of the emulsion for coating and less in fogging due to rapid development processing.

12 Claims, No Drawings

SILVER HALIDE COLOR PHOTOGRAPHIC MATERIAL CONTAINING A STABILIZED HIGH SILVER CHLORIDE EMULSION

This application is a divisional of application Ser. No. 07/638,526, filed Jan. 8, 1991, now abandoned.

FIELD OF THE INVENTION

The present invention relates to silver halide color photographic materials, and more particularly to silver halide color photographic materials that will be less fogged when the emulsion is applied after a lapse of time from preparation or when the photographic material is subjected to rapid development processing.

BACKGROUND OF THE INVENTION

In recent years there has been strong demand for the development processing step of silver halide color photographic materials to be more rapid, and technical developments for shortening the development processing step have been made successfully and introduced into the market. Specifically, there have been improvements in the formulation of the development, improvements in equipment, represented by the mini-lab, and improvements in the photographic materials.

As an improvement in the photographic materials, silver halide grains having a high content of silver chloride, whose developing speed is high, have been used. By using photographic materials containing silver chlorobromide grains that contain silver chloride in an amount of 95 mol % or over, the development processing step is made more rapid.

Photographic materials that use a silver halide having a high content of silver chloride are advantageous in that the developing speed is high. But on the other hand, it is generally known that such photographic materials are disadvantageous in that fogging is liable to appear. It is required to somehow minimize fogging.

As antifoggants, for example, azaindenes, azoles, heterocyclic mercapto compounds, and thioketo compounds are known. In particular, mercapto compounds such as mercaptothiazoles, mercaptobenzothiazoles, mercaptobenzimidazoles, mercaptothiadiazoles, mercaptotetrazoles, and mercaptopyrimidines are effective. However, these compounds suffered from defects such as they have little effect on minimizing fogging that will occur when the emulsion is applied after the lapse of time from preparation (i.e. during the period until it is coated after preparation). Further, when these compounds are added in a large amount, the sensitivity lowers greatly. Therefore, the amount which can be used is limited.

U.S. Pat. No. 3,047,393 and JP-B ("JP-B" means examined Japanese patent publication) No. 27486/1983 disclose the use of a thiosulfonic acid compound as an antifoggant. However, it was found that when emulsions having a high silver chloride content were applied to photographic materials having a reflective base, and particularly to reflecting photographic materials such as color print materials, the prevention of fogging was not adequate and sensitivity was lowered.

U.S. Pat. No. 2,394,198 discloses a method to prevent fogging by using a combination of a thiosulfonic acid compound and a sulfinic acid compound. However, for color papers processing time was about 10 minutes for the method at that time. It was revealed that when photographic materials proposed in the U.S. patent were subjected to rapid processing, sensitivity and fogging were not controlled satisfactorily, and emulsions highly sensitive enough to be practically used could not be provided. Further the fogging for a reflecting photographic material was unsatisfactory.

SUMMARY OF THE INVENTION

The first object of the present invention is to provide a silver halide color photographic material that advantageously utilizes silver halide grains containing silver chloride in an amount of 95 mol % or over, and which permits less fogging to occur, and when the emulsion is applied after the lapse of time from preparation.

The second object of the present invention is to provide a silver halide color photographic material low in fogging during the time it is subjected to rapid development processing.

Other and further objects, features, and advantages of the invention will be more fully apparent from the following description.

DETAILED DESCRIPTION OF THE INVENTION

The above objects have been achieved by providing a silver halide color photographic material having at least one silver halide emulsion layer on a base, which comprises, in the silver halide emulsion layer, a silver chlorobromide emulsion or a silver chloride emulsion having a silver chloride content of 95 mol % or more, wherein a combination of a thiosulfonic acid compound of formula (I) given below and a sulfinic acid compound of formula (II) given below are added in a step of the production of said emulsion, followed by sulfur-sensitization:

$$R_1—SO_2S—M_1 \qquad \text{Formula (I)}$$

$$R_2—SO_2—M_2 \qquad \text{Formula (II)}$$

wherein $R_1$ and $R_2$ each represent an aliphatic group, aromatic group, or heterocyclic group, and $M_1$ and $M_2$ each represent a cation. In this specification and claims, the aliphatic group, aromatic group or heterocyclic group includes substituted or unsubstituted ones.

The silver halide emulsion used in the present invention is a silver chlorobromide emulsion or a silver chloride emulsion. The silver chlorobromide emulsion has a silver chloride content of 95 mol % or over, preferably 98 mol % or over. Preferably silver iodide is not included, but if it is included the amount is preferably 1 mol % or below.

The halogen composition of the silver halide emulsion used in the present invention may differ from grain to grain or it may be the same among the grains, and if an emulsion whose halogen composition is the same among the grains is used, it is easy to make the properties of the grains uniform from grain to grain. With respect to the halogen composition distribution in the individual silver halide emulsion grains, for example, grains having a so-called uniform-type structure, wherein the composition is the same throughout the silver halide grain, or grains having a so-called layered-type structure, wherein the halogen composition of the core of the silver halide grain is different from that of the shell (comprising a single layer or layers) surrounding the core, or grains having a structure wherein non-layered parts whose halogen composition is different from part to part are present within the grain or on the surface of the grain (if the non-layered parts are present on the grain surface, the parts having different compositions join the edges, corners, or planes) can be suitably selected. To secure high sensitivity, the latter two structures rather than the uniform-type structure are advantageously used and are preferable in view of pressure resistance. If the silver halide grains have such structures, the boundary part between the parts where the halogen composition differs may be clear or obscure owing to the formation of mixed crystals due to the composition difference, or the boundary part may be continuously changed positively in structure.

In high-silver-chloride emulsions used in the present invention, the structure is preferably such that the silver bromide localized phase is in the layered form or non-layered form, as mentioned above, and is present in the silver halide grain and/or on the surface of the silver halide grain. The halogen composition of the localized phase is preferably such that the silver bromide content is at least 10 mol %, and more preferably over 20 mol %. The localized phase may be present in the grain, or on the edges or corners of the grain surfaces, or on the planes of the grains, and a preferable example is a localized phase epitaxially grown on each corner of the grain.

On the other hand, it is preferable to use grains having a uniform-type structure, wherein the halogen composition distribution in the grain is small, for the purpose of suppressing the lowering of sensitivity as much as possible when the photographic material is subjected to pressure.

The average grain size of the silver halide grains contained in the silver halide emulsions used in the present invention (the average grain size being the number average obtained by assuming the diameters of circles equivalent to the projected areas of the grains to be grain sizes) is preferably 0.1 to 2 μm.

Preferably their grain size distributions are ones having a deviation coefficient (which is obtained by dividing the standard deviation of the grain size distribution by the average grain size) of 20% or less, and desirably 15% or less, that is, so-called monodisperse distributions. In this case, in order to obtain wide latitude, also preferably the above-mentioned monodisperse emulsions are blended and used in the same layer, or they are applied as layers one upon the other.

The shape of the silver halide grains contained in the photographic emulsions may be of a regular crystal form, such as a cubic form, a tetradecahedral form, or an octahedral form, or of an irregular crystal form, such as a spherical form or tubular form, or of a composite form of these. The silver halide grains may be made up of a mixture of silver halide grains having various crystal forms. In the present invention, among these, good grains are those wherein 50% or over, preferably 70% or over, and more preferably 90% or over, have the above regular crystal form.

In addition, emulsions can also be preferably used wherein tubular grains having an average aspect ratio (in terms of circle diameter/thickness) of 5 or over, preferably 8 or over, amount to over 50% of all the grains in terms of projected area.

The silver chlorobromide emulsions used in the present invention can be prepared by the methods described, for example, by P. Glafkides in "Chimie et Phisique Photographique" (published by Paul Montel, 1967), by G. F. Duffin in "Photographic Emulsion Chemistry" (published by Focal Press, 1966), and by V. L. Zelikman et al. in "Making and Coating Photographic Emulsion" (Focal Press, 1964). That is, any method of the acid method, the neutral method, the ammonia method, etc., can be used, and as the type wherein a soluble silver salt and a soluble silver halide are reacted, any method of the single jet method, the double-jet method, the combined method of these, etc., can be used. Also the method wherein grains are formed in a condition containing excess silver ions, that is, the so-called reverse precipitation method, can also be used. As one type of the double-jet method, a method wherein the pAg in the liquid phase where the silver halide is formed is kept constant, that is, the so-called controlled double-jet method, can also be used. According to the controlled double-jet method, a silver halide emulsion wherein the crystal form is regular and the grain size is nearly uniform can be obtained.

Into the silver halide emulsions used in the present invention can be introduced various polyvalent metal ion impurities in the process of the formation or physical ripening of the emulsion grains. Examples of the compound to be used include a salt of cadmium, zinc, lead, copper, thallium, etc., and a salt or complex salt of iron, platinum, iridium, osmium, palladium, rhodium, and ruthenium, that are elements of Group VIII. In particular, the above elements of Group VIII can be preferably used. The amount of these compounds to be added varies over a wide range to meet the purpose, preference being given to $10^{-9}$ to $10^{-2}$ mol for the silver halide.

For optical sensitization of silver halide emulsions used in the present invention, preferably sulfur sensitization and gold sensitization are used in combination. It is also possible to use sulfur sensitization and selenium sensitization in combination.

As a sulfur sensitizer, for example, thiosulfates, rhodanines, thioureas, and thioamides (e.g., compounds described in U.S. Pat. Nos. 2,410,689, 3,501,313, 2,278,947, 1,574,944, 2,728,668, 3,656,955, 4,001,025, and 4,116,697 and JP-A ("JP-A" means unexamined published Japanese patent application) No. 45016/1980), thioesters (e.g., JP-B ("JP-B" means examined Japanese patent publication) Nos. 13485/1968 and 42374/1980 and British Patent No. 1,190,678), and polysulfur compounds (U.S. Pat. Nos. 3,647,469, 3,656,955, and 3,689,273, JP-A No. 81230/1978, and JP-B Nos. 20533/1974 and 45134/1984) are used.

As a gold sensitizer, gold complex salts, such as chloroauric acid, are preferably used.

As selenium sensitizers, known unstable selenium compounds can be used, and specifically colloidal metal selenium and known selenium compounds, such as selenoureas (e.g., N,N-dimethylselenourea and N,N-diethylselenourea), selenoketones, and selenoamides are used.

The step of producing silver halide emulsions used in the present invention includes the step of forming grains, the step of physical ripening, the step of desalting, the step of dispersing, the step of chemical sensitizing, and the step of preparing a finished emulsion for coating. The addition of a thiosulfonic acid compound and a sulfinic acid compound may be carried out in any of the above steps, and they can be added in separate steps individually. Preferably they are allowed to be present together in the step of the formation of silver halide grains and/or the step of chemical sensitization.

If both of them are allowed to be present in the step of the formation of grains and the pH in that step is adjusted to 3.0 to 5.5, preferably 3.0 to 4.8, the effect of preventing fogging becomes more conspicuous.

Thiosulfonic compounds represented by formula (I) and sulfinic acid compounds represented by formula (II) of the present invention will now be described in more detail.

In formulae (I) and (II), aliphatic groups represented by $R_1$ and $R_2$ include straight-chain, branched, or cyclic alkyl, alkenyl, and alkynyl groups, and although there is no particular limit to the number of carbon atoms contained therein, preferably the number of carbon atoms contained therein is such that the compound can be dissolved in water or an organic solvent, such as ethyl acetate, or a lower alcohol, for example methanol and ethanol, or a mixed solvent of these. The number of carbon atoms of the aliphatic group is preferably 1 to 20.

Aromatic groups represented by $R_1$ and $R_2$ include a phenyl group and a naphthyl group, and as the heterocyclic group, 5- to 7-membered saturated or unsaturated rings containing at least one of N, O, and S atoms as a hetero atom can be mentioned. The ring may have other ring, such as a benzene ring, fused thereto.

Although there is no particular limitation to the number or the type of substituents that may be substituted on these groups, preferable substituents are those which facilitate the dissolving of the compound in water, or organic solvents mentioned above or a mixed solvent thereof or those which at least do not obstruct the dissolution of the compound.

As specific examples of the substituents, an alkoxy group, an aryl group, an alkyl group, a halogenatom, an amino group, a carboxyl group, a hydroxyl group, and a heterocyclic group can be mentioned.

As a cation represented by $M_1$ and $M_2$, an alkali metal ion (e.g., $Li^+$, $Na^+$, and $K^+$) and an ammonium ion (e.g., $NH^4$ and a tetramethylammonium ion) can be mentioned.

Typically specific examples of a thiosulfonic acid compound and a sulfinic acid compound are listed below.

$CH_3SO_2SNa$ (I-1)

$C_2H_5SO_2SNa$ (I-2)

$C_2H_5SO_2SK$ (I-3)

$C_4H_9SO_2SLi$ (I-4)

$C_6H_{13}SO_2SNa$ (I-5)

$C_8H_{17}SO_2SNa$ (I-6)

$CH_3(CH_2)_3CH(C_2H_5)CH_2SO_2S.NH_4$ (I-7)

$C_{10}H_{21}SO_2SNa$ (I-8)

$C_{12}H_{25}SO_2SNa$ (I-9)

$C_{16}H_{33}SO_2SNa$ (I-10)

$(CH_3)_2CH-SO_2SK$ (I-11)

$t\text{-}C_4H_9SO_2SNa$ (I-12)

$CH_3OCH_2CH_2SO_2S.Na$ (I-13)

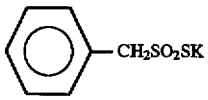
(I-14)

$CH_2=CHCH_2SO_2SNa$ (I-15)

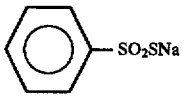
(I-16)

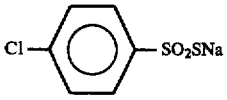
(I-17)

-continued

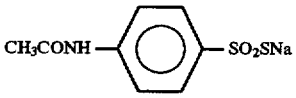
(I-18)

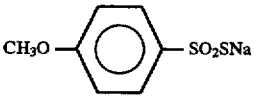
(I-19)

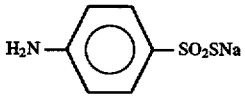
(I-20)

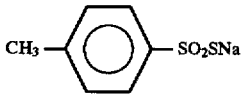
(I-21)

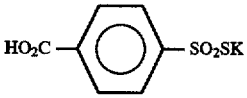
(I-22)

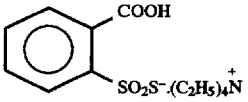
(I-23)

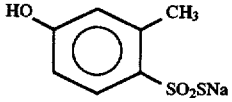
(I-24)

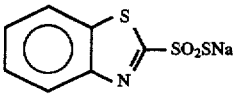
(I-25)

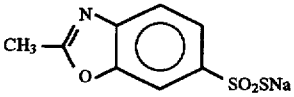
(I-26)

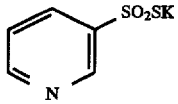
(I-27)

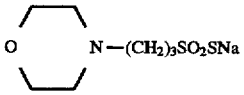
(I-28)

$CH_3SO_2.Na$ (II-1)

$C_2H_5SO_2.Na$ (II-2)

$C_3H_7SO_2.K$ (II-3)

$C_4H_9SO_2.Li$ (II-4)

$C_6H_{13}SO_2.Na$ (II-5)

$C_8H_{17}SO_2.Na$ (II-6)

$CH_3(CH_2)_3CH(C_2H_5)CH_2SO_2.NH_4$ (II-7)

$C_2H_5$ (II-8)

$C_{12}H_{25}SO_2.Na$ (II-9)

$C_{16}H_{33}SO_2.Na$ (II-10)

-continued (II-11)

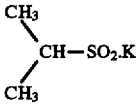

(II-12) $t\text{-}C_4H_9SO_2.Na$ (II-13) $CH_3OCH_2CH_2SO_2.Na$ (II-14)

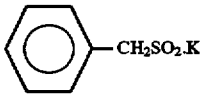

(II-15) $CH_2{=}CHCH_2SO_2.Na$ (II-16)

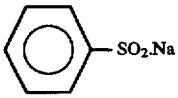

(II-17)

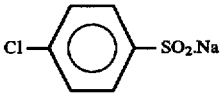

(II-18)

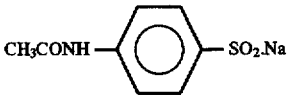

(II-19)

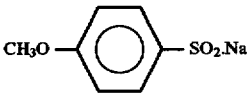

(II-20)

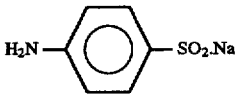

(II-21)

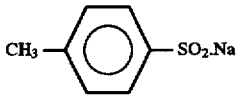

(II-22)

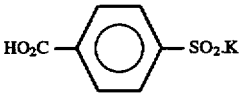

(II-23)

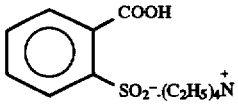

(II-24)

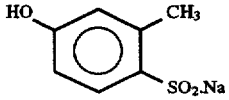

(II-25)

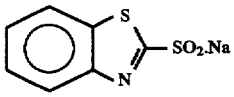

(II-26)

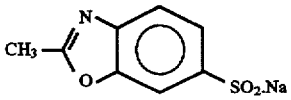

(II-27)

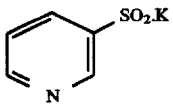

-continued (II-28)

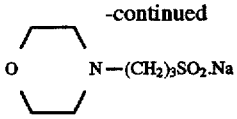

Amounts of thiosulfonic acid compound and sulfinic acid compound to be added each are $1\times10^{-6}$ to $3\times10^{-4}$ mol, preferably $3\times10^{-6}$ to $8\times10^{-5}$ mol, per mol of silver halide.

Preferably these compounds are, after dissolved in water or the above-described organic solvent, added into an aqueous solution of hydrophilic colloid.

Generally, the silver halide emulsion used in the present invention is spectrally sensitized.

The spectral sensitization is carried out for the purpose of providing the emulsions of the layers of the photographic material of the present invention with spectral sensitivity in desired wavelength regions. In the present invention, the spectral sensitization is preferably carried out by adding dyes that absorb light in the wavelength ranges corresponding to the aimed for spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (right upper column) to page 38, are preferably used.

The amount of spectral sensitizing dye to be added is $1\times10^{-6}$ to $1\times10^{-3}$ mol, preferably $2\times10^{-5}$ to $5\times10^{-4}$ mol, per mol of silver halide.

The position of adding spectral sensitizing dye is selected in arbitrarily from grain-forming process to immediately before coating, preferably it is added grain-forming process and/or chemical sensitization.

The color photographic material of the present invention may be made by applying on a base at least one blue-sensitive silver halide emulsion layer, at least one green-sensitive silver halide emulsion layer, and at least one red-sensitive silver halide emulsion layer. Generally, in color papers, it is common that the emulsion layers are applied in the above-stated order, although the order may be different therefrom. An infrared-sensitive silver halide emulsion layer can be used instead of at least one of the above emulsion layers. By incorporating, into the photosensitive emulsion layers, silver halide emulsions sensitive to respective wavelength regions, and dyes complementary to the lights to which they are sensitive, that is, so-called color couplers for forming yellow for blue, magenta for green, and cyan for red, color reproduction of the subtractive color process can be effected. However, the photosensitive layers and the color-forming hues of the couplers may be constituted not to have the above correspondence.

Cyan couplers, magenta couplers, and yellow couplers preferably used in the present invention are those represented by the following formulae (C-1), (C-II), (M-I), (M-II), and (Y):

Formula (C-I)

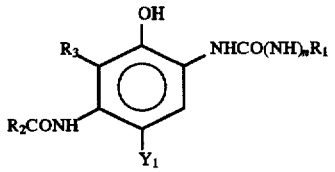

-continued

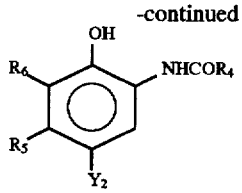

Formula (C-II)

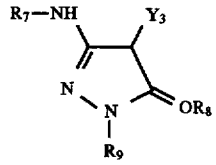

Formula (M-I)

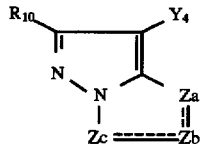

Formula (M-II)

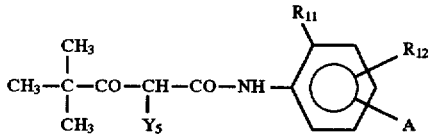

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$—SO_2\underset{\underset{R_{14}}{|}}{N}—R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.
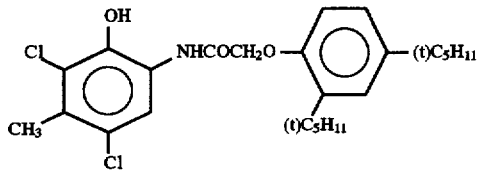
(C-1)
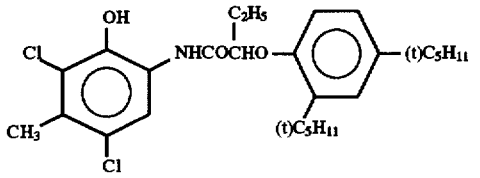
(C-2)
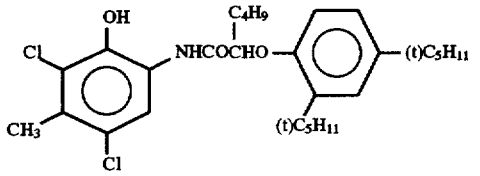
(C-3)
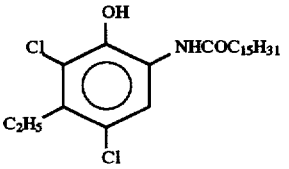
(C-4)
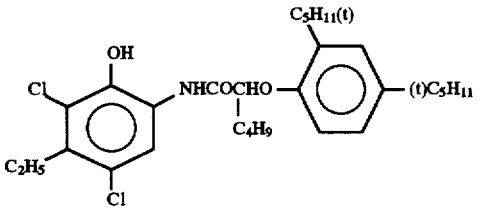
(C-5)
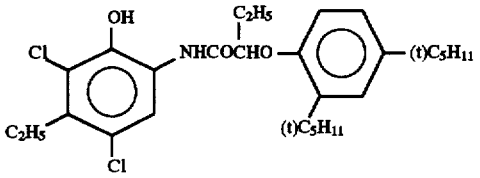
(C-6)
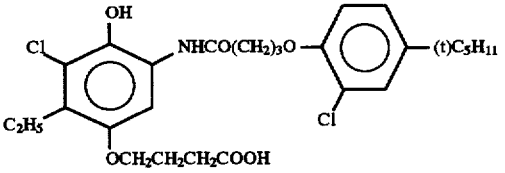
(C-7)
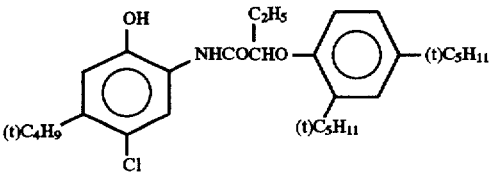
(C-8)

-continued
(C-9)
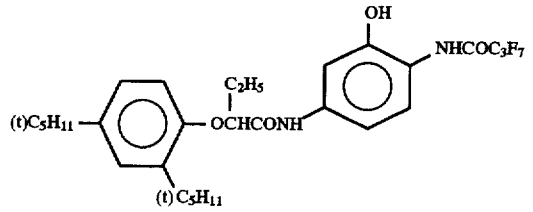
(C-10)
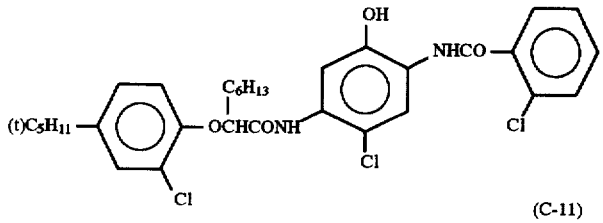
(C-11)
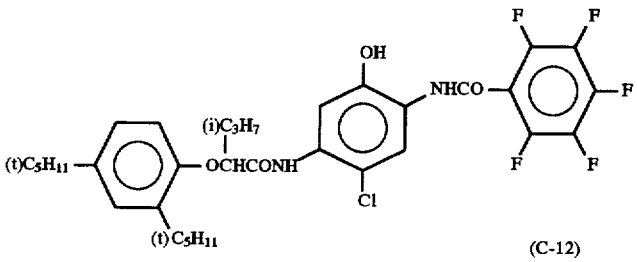
(C-12)
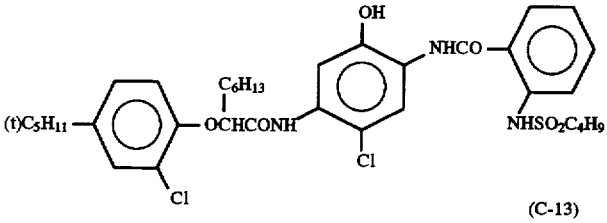
(C-13)
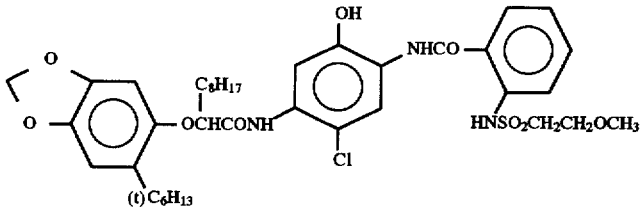
(C-14)
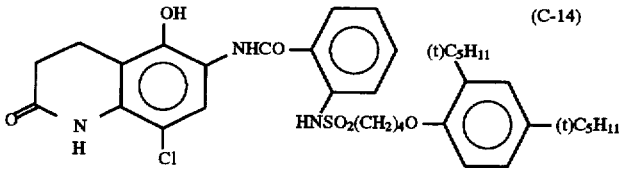
(C-15)
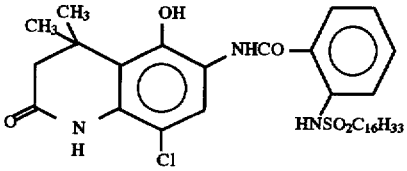
(C-16)
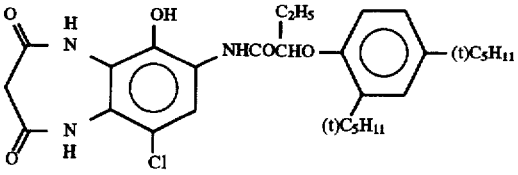

-continued
(C-17)
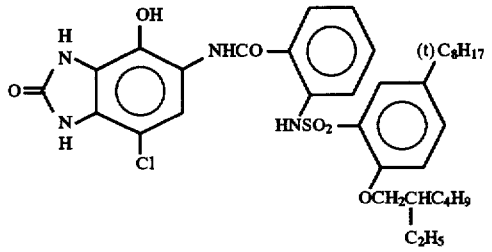
(C-18)
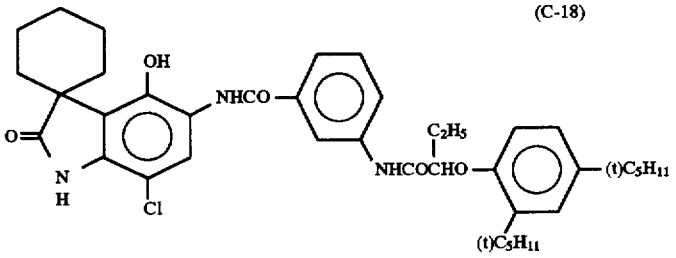
(C-19)
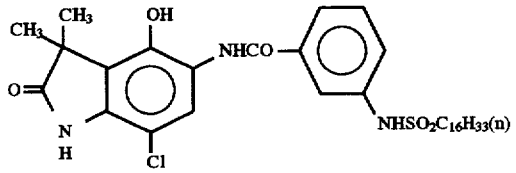
(C-20)
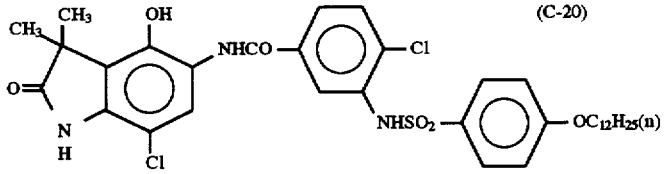
(C-21)
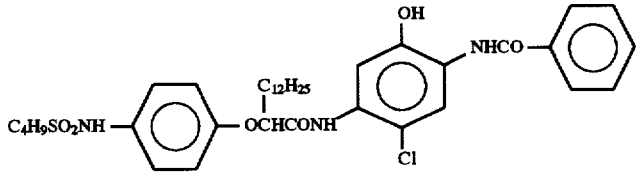
(C-22)
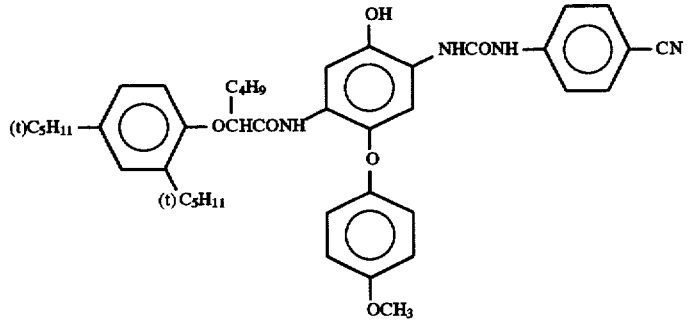

-continued
(M-1)
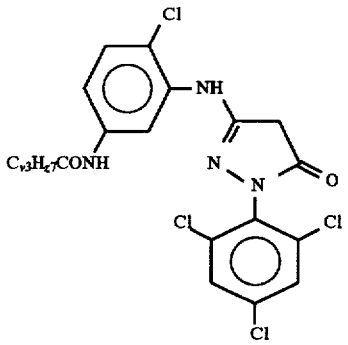
(M-2)
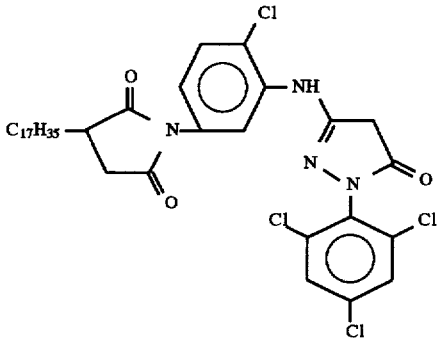
(M-3)
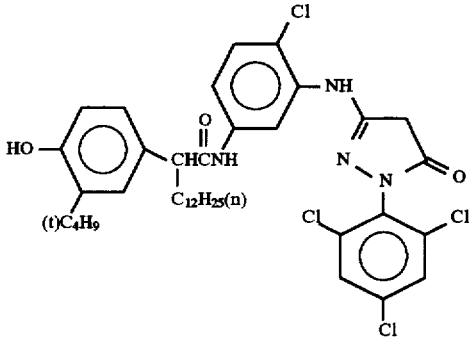
(M-4)
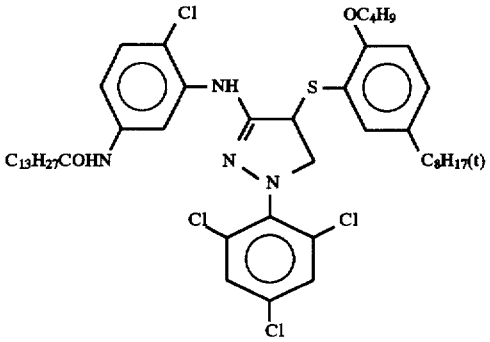

-continued
(M-5)
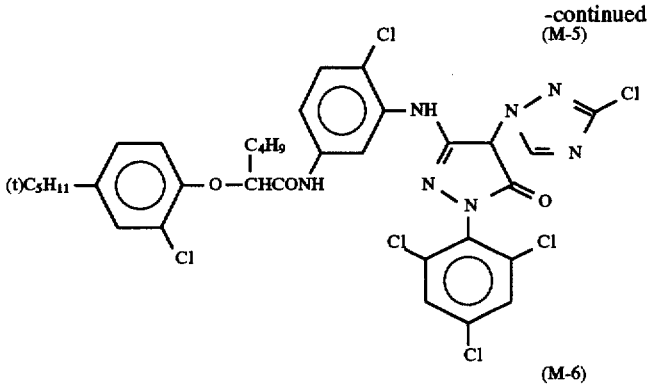
(M-6)
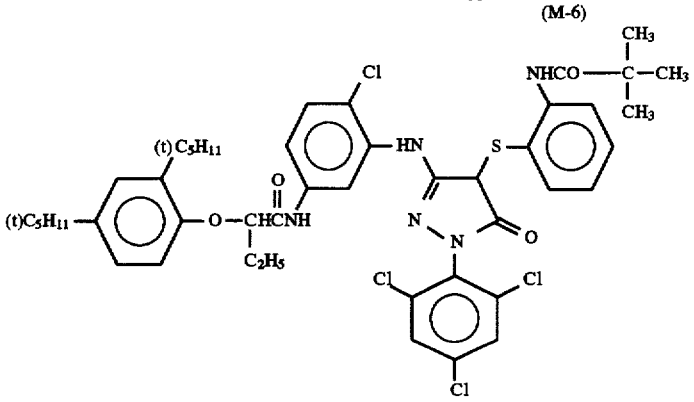
(M-7)
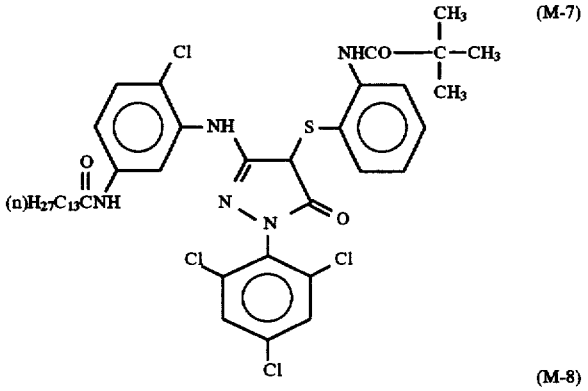
(M-8)
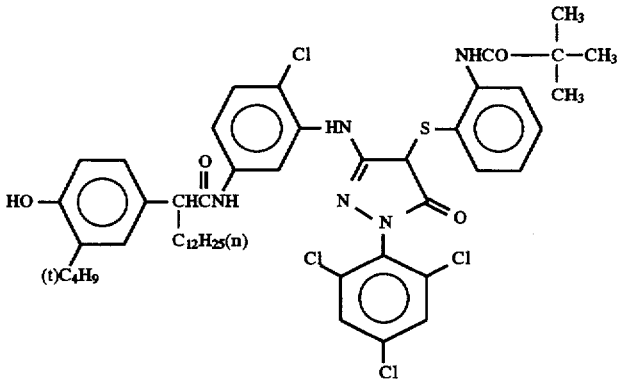

| Compound | $R_{10}$ | $R_{15}$ | $Y_4$ |
|---|---|---|---|
| | | 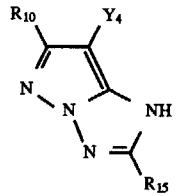 | |
| M-9 | $CH_3-$ | 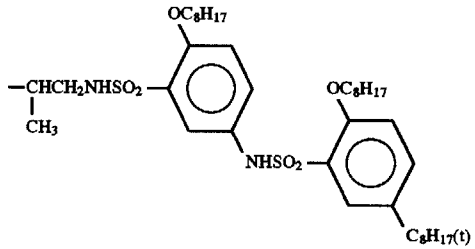 | Cl |
| M-10 | The same as the above | 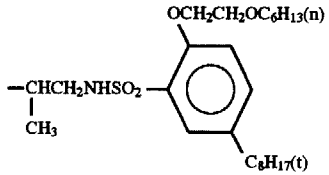 | The same as the above |
| M-11 | $(CH_3)_3C-$ | 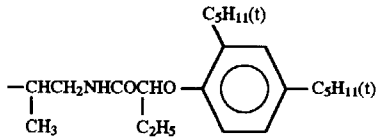 | 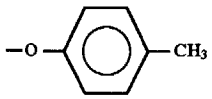 |
| M-12 | 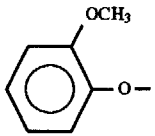 | 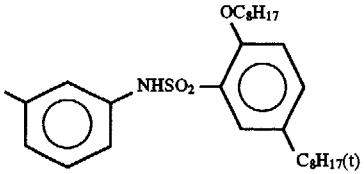 | 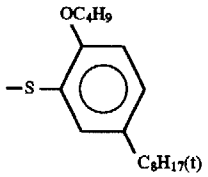 |

-continued
| Compound | $R_{10}$ | $R_{15}$ | $Y_4$ |
|---|---|---|---|
| M-13 | $CH_3-$ | 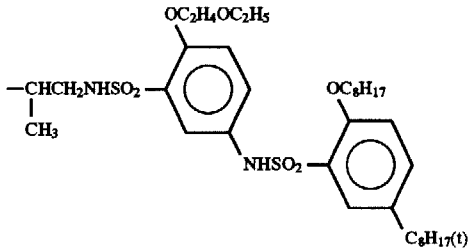 | Cl |
| M-14 | The same as the above | 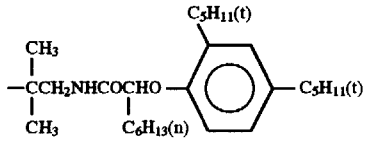 | The same as the above |
| M-15 | The same as the above | 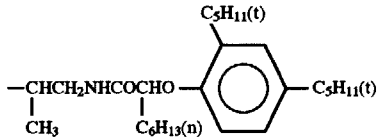 | The same as the above |
| M-16 | The same as the above | 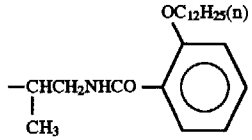 | The same as the above |
| M-17 | The same as the above | 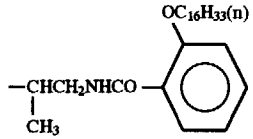 | The same as the above |

-continued
| Compound | $R_{10}$ | $R_{15}$ | $Y_4$ |
|---|---|---|---|
| M-18 | 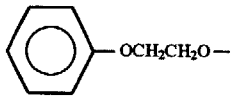 | 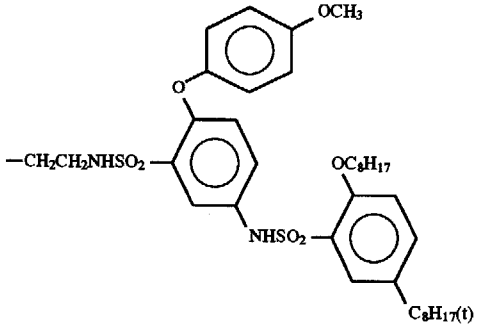 | 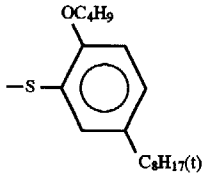 |
| M-19 | $CH_3CH_2O-$ | The same as the above | The same as the above |
| M-20 | 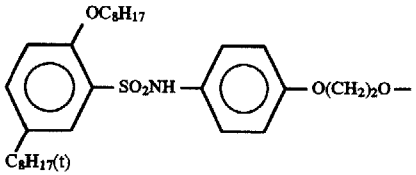 | 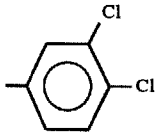 | 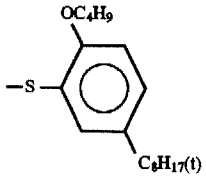 |
| M-21 | 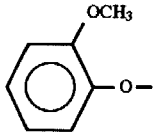 | 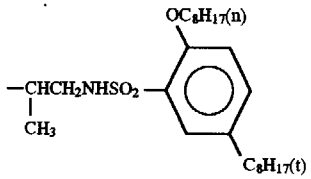 | Cl |
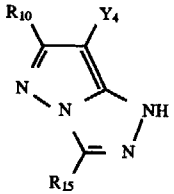

-continued
| Compound | $R_{10}$ | $R_{15}$ | $Y_4$ |
|---|---|---|---|
| M-22 | $CH_3-$ | 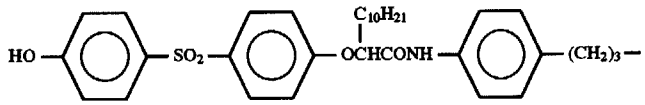 | Cl |
| M-23 | The same as the above | 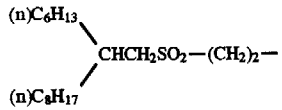 | The same as the above |
| M-24 | 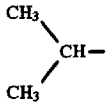 | 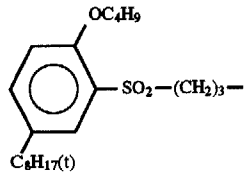 | The same as the above |
| M-25 | 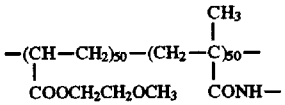 | 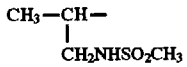 | The same as the above |
| M-26 | 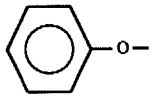 | 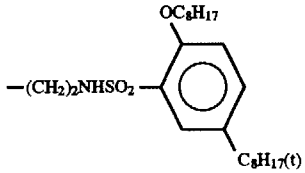 | The same as the above |
| M-27 | $CH_3-$ | 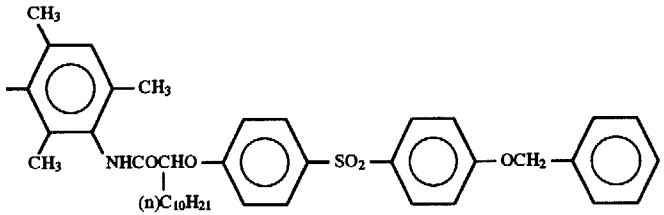 | Cl |

-continued
| Compound | $R_{10}$ | $R_{15}$ | $Y_4$ |
|---|---|---|---|
| M-28 | $(CH_3)_3C-$ | 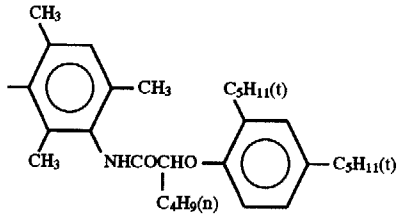 | The same as the above |
| M-29 | 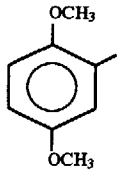 | 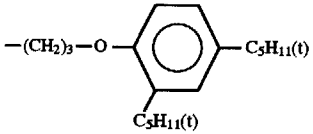 | The same as the above |
| M-30 | $CH_3-$ | 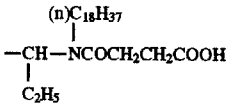 | The same as the above |

(Y-1)
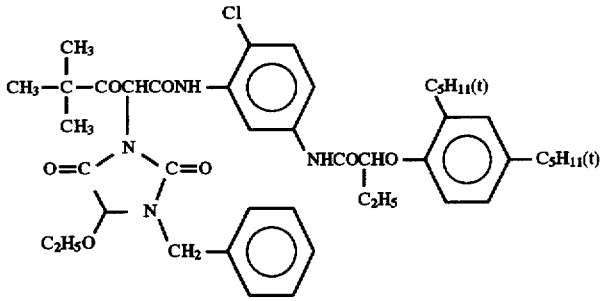
(Y-2)
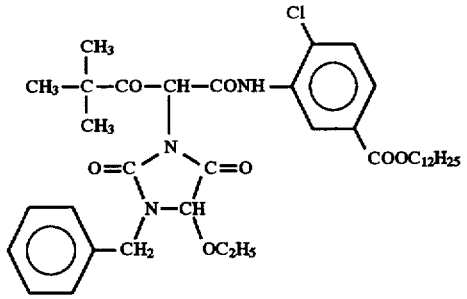
(Y-3)
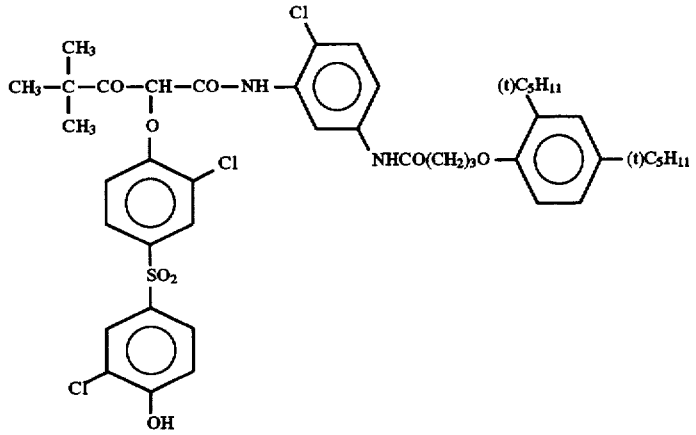
(Y-4)
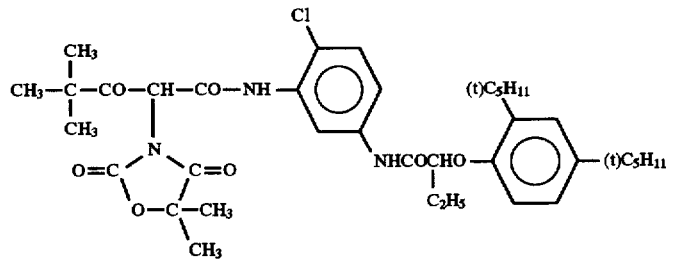
(Y-5)
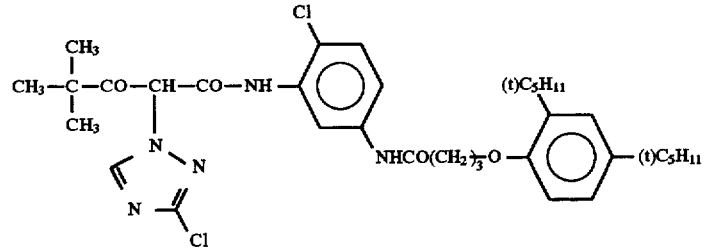

-continued (Y-6)

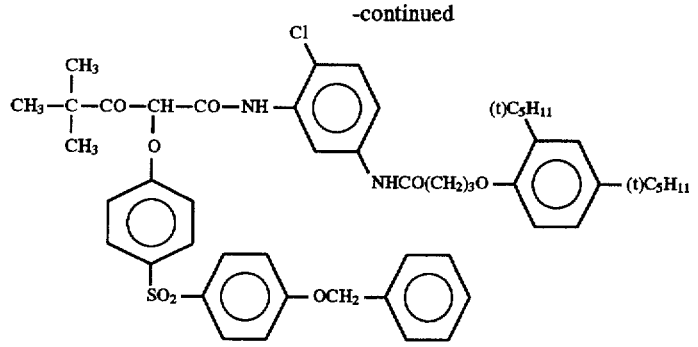

(Y-7)

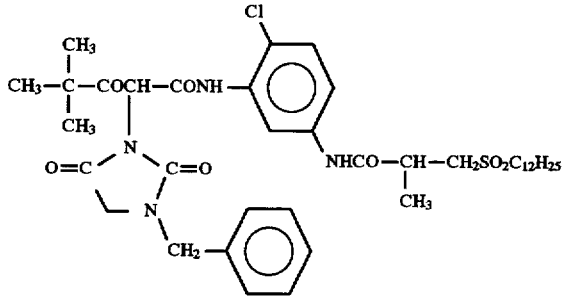

(Y-8)

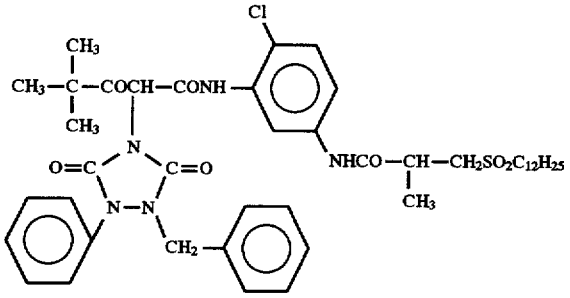

(Y-9)

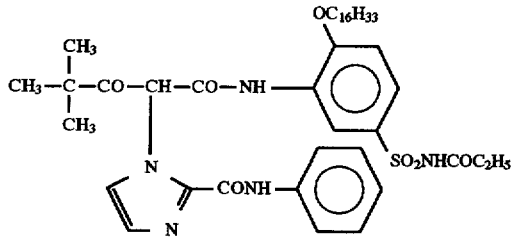

The couplers represented by formulae (C-I), (C-II), (M-I), (M-II), and (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

Formula (A')

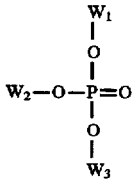

-continued $W_1-COO-W_2$ Formula (B')

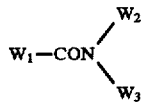

Formula (C')

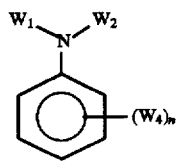

Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S—W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato) nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat.. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 l/mol.sec to $1\times10^{-5}$ l/mol.sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_{21}-(A_1)n-X \qquad \text{Formula (FI)}$$

$$R_{22}-\underset{\underset{B_1}{|}}{C}=Y \qquad \text{Formula (FII)}$$

wherein $R_{21}$ and $R_{22}$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{21}$ and X, or Y and $R_{22}$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_{23}-Z \qquad \text{Formula (GI)}$$

wherein $R_{23}$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-\bar{R})^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino] aniline
D-6: 4-amino-3-methyl-N-ethyl-N-[β-(methanesulfonamido)ethyl]-aniline
D-7: N-(2-amino-5-diethylaminophenylethyl) methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido) ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethyleneditriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai*

*no Kagaku* (1986) published by Sankyo-Shuppan, *Biseibutsu no Genkin, Sakkin, Bobai Gijutsu* (1982), edited by Eiseigijutsu-kai published by Kogyo-Gijutsu kai, and in *Bokin Bobai-zai Jiten* (1986) edited by Nihon Bokin Bobai-gakkai, can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

The preferable replenishing amount per unit area of photographic material is 0.5 to 50 times, more preferably 3 to 40 times amount of solution carried over from the preceding bath. In other words, it is 1 liter or below, preferably 500 ml or below, per square meter of photographic material. The replenishing may be carried out continuously or intermittently.

Solutions which used in washing process and/or stabilizing process can be used further in preceding process. Of this example it can be mentioned that the overflow of washing water which reduced by multi-stage counter current system is introduced to the preceding bleach-fixing bath and a concentrated solution is replenished into the bleach-fixing bath to reduce the waste solution.

The present invention can provide a silver halide photographic material that is suitable for a rapid processability, high in sensitivity and less fogging by utilizing a silver halide emulsion that is stable and less change on standing.

The present invention will now be described below with eference to Examples, which are not intended to limit the present invention.

EXAMPLE 1

A silver chlorobromide emulsion was prepared as follows.

3.3 g of sodium chloride was added to a 3% aqueous solution of lime-treated gelatin, and then 3.2 ml of N,N'-dimethylimidazolidine-2-thione (1% aqueous solution) was added thereto. An aqueous solution containing 0.5 mol of silver nitrate and an aqueous solution containing 0.5 mol of sodium chloride were added to and mixed with the resulting solution at 66° C. with violent stirring. Then, an aqueous solution containing 0.5 mol of silver nitrate and an aqueous solution containing 4 mg of potassium hexacyanoferrate(II) trihydrate and 0.5 mol of sodium chloride were added to and mixed with the solutions with violent stirring. After keeping the solution at 66° C. for 5 min, the temperature was lowered, and desalting and washing with water were effected. Further, 90.0 g of lime-treated gelatin was added thereto, and after the pH and the pAg were adjusted, spectral sensitizing dye (a), a silver bromide fine-grain emulsion (having an average particle size of 0.05 μm) corresponding to 1 mol % for the silver halide, and triethyl thiourea were added, to effect spectral sensitization and chemical sensitization. As a result, a cubic silver chlorobromide emulsion having an average grain size of 0.95 μm, a deviation coefficient of 0.07, and a silver chloride content of 98 mol % was obtained, which was designated as emulsion (A).

By the same procedure as the above, except that the pH at which the grains were formed, the type or amount of the thiosulfinic acid compound and the sulfinic acid compound, the chemical sensitization method, etc., were changed, optimized emulsions (B) to (M) were prepared.

They are given in Table 1.

Spectral sensitizing dye:

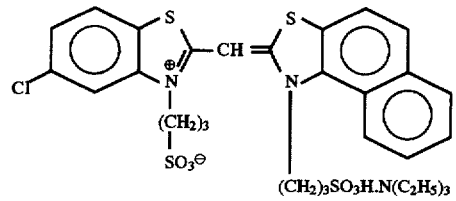

($3 \times 10^{-4}$ mol per mol of silver halide)

TABLE 1

| Emulsion | pH when grain was formed | Triethyl thiourea (mol)* | Chloroauric acid (mol)* | Thiosulfonic acid compound** (mol)* | Sulfinic acid compound** (mol)* | Remarks |
|---|---|---|---|---|---|---|
| (A) | 6.3 | $1 \times 10^{-5}$ | — | — | — | Comparative Example |
| (B) | 6.3 | $1 \times 10^{-5}$ | — | — | — | Comparative Example |
| (C) | 3.6 | $1 \times 10^{-5}$ | — | — | — | Comparative Example |
| (D) | 4.7 | $1 \times 10^{-5}$ | — | (I-8) $5 \times 10^{-6}$ | (II-8) $5 \times 10^{-6}$ | This Invention |
| (E) | 3.6 | $1 \times 10^{-5}$ | — | (I-8) $5 \times 10^{-6}$ | (II-8) $5 \times 10^{-6}$ | This Invention |
| (F) | 3.6 | $1 \times 10^{-5}$ | — | (I-16) $5 \times 10^{-6}$ | (II-16) $5 \times 10^{-6}$ | This Invention |
| (G) | 3.6 | $1 \times 10^{-5}$ | — | (I-27) $5 \times 10^{-6}$ | (II-20) $2 \times 10^{-6}$ | This Invention |
| (H) | 3.6 | $1 \times 10^{-5}$ | $1 \times 10^{-7}$ | — | — | Comparative Example |
| (I) | 3.6 | $1 \times 10^{-5}$ | $1 \times 10^{-7}$ | (I-16) $5 \times 10^{-6}$ | (II-16) $5 \times 10^{-6}$ | This Invention |
| (J) | 3.6 | $1 \times 10^{-5}$ | $1 \times 10^{-7}$ | (I-21) $5 \times 10^{-6}$ | (II-21) $5 \times 10^{-6}$ | This Invention |
| (K) | 3.6 | $1 \times 10^{-5}$ | $1 \times 10^{-7}$ | (I-16) $2 \times 10^{-5}$ | (II-16) $1 \times 10^{-5}$ | This Invention |
| (L) | 3.6 | $1 \times 10^{-5}$ | — | (I-16) $2 \times 10^{-5}$ | (II-16) $1 \times 10^{-5}$ | This Invention |
| (M) | 6.3 | $1 \times 10^{-5}$ | — | (I-16) $2 \times 10^{-5}$ | (II-16) $1 \times 10^{-5}$ | This Invention |

Note:
*mol per mol of silver halide
**added at the time of chemical sensitization Multilayer color print papers having layer constitutions as shown below on paper bases laminated on both sides with polyethylene were prepared. Coating solutions were prepared as follows.

Preparation of first layer coating solution 27.2 ml of ethyl acetate and 8.2 g of Solvent (Solv-1) were added to 19.1 g of Yellow Coupler (ExY), 4.4 g of Dye Stabilizer (Cpd-1), and 1.4 g of Dye Stabilizer (Cpd-7), to dissolve them, and the solution was emulsified and dispersed in 185 ml of a 10% aqueous gelatin solution containing 8 ml of 10% of sodium dodecylbenzenesulfonate.

The emulsified dispersion was mixed and dissolved in the above emulsion, to prepare a first layer coating solution having the composition shown below. As a gelatin hardener for each layer, 1-oxy-3,5-dichloro-s-triazine sodium salt was used.

(Composition of Layers)

The compositions of the layers are shown below. The figures indicate coating amounts (g/m$^2$). The amount of the silver halide emulsion is given in terms of applied silver.

Base

Polyethylene-laminated paper (White pigment ($TiO_2$) and blueing dye (marine blue), are contained in polyethylene film of first layer side)

| | |
|---|---|
| First Layer (Blue-sensitive emulsion layer): | |
| Silver chlorobromide emulsion above described | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Protective layer): | |
| Gelatin | 1.33 |
| Acryl-modified copolymer of poly(vinyl alcohol) (Modification degree: 17%) | 0.17 |
| Liquid paraffin | 0.03 |

Samples (101) t (113) were prepared by exchanging emulsion above-described from (A) to (M). These samples were subjected to a gradational exposure to light through three color separated filter (filters B: TB-5, TG-5, and R: TR-5, made by Fuji Photo Film Co., Ltd.) using a sensitometer (FWH model made by Fuji Photo Film Co., Ltd., the color temperature at light source was 3200 K). The exposure was conducted to give an exposure time of one tenth and an exposure amount of 250 CMS. After exposure to light, each sample was subjected to a processing by the processing process shown below using solutions of which composition are shown below using an automatic processor.

| Processing step | Temperature | Time | Replenisher | Tank Volume |
|---|---|---|---|---|
| Color developing | 35° C. | 45 sec. | 161 ml | 17 l |
| Bleach-fixing | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

Note:

*Replenisher amount per m$^2$ of photographic material.

Rinsing steps were carried out in 3-tanks countercurrent mode from the tank of rinsing (3) toward the tank of rinsing (1).

The composition of each processing solution is as followed, respectively:

| Color-developer | Tank Solution | Replenisher |
|---|---|---|
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 5.5 g | 7.0 g |
| Fluorescent whitening agent (WHITEX-4B, made by Sumitomo Chemical Ind.) | 1.0 g | 2.0 g |
| Water to make | 1000 ml | 1000 ml |
| pH | 10.05 | 10.45 |

Bleach-fixing solution
(Both tank solution and replenisher)

| | |
|---|---|
| Water | 400 ml |
| Ammonium thiosulfate | 700 g |
| Sodium sulfite | 17 g |
| Iron (III) ammonium ethylenediaminetetraacetate.dihydrate | 55 g |
| Disodium ethylenediaminetetraacetate | 5 g |
| Ammonium bromide | 40 g |
| Water to make | 1000 ml |
| pH | 6.0 |

Rinsing solution
(Both tank solution and replenisher)

Ion-exchanged water (calcium and magnesium each are 3 ppm or below)

Sensitivity and fogging of each sample (101) to (113) are shown in Table 2.

TABLE 2

| Sample | Emulsion | Sensitivity | Fogging | Remarks |
|---|---|---|---|---|
| (101) | (A) | 100 | 0.20 | Comparative Example |
| (102) | (B) | 102 | 0.19 | Comparative Example |
| (103) | (C) | 102 | 0.18 | Comparative Example |
| (104) | (D) | 110 | 0.11 | This Invention |
| (105) | (E) | 116 | 0.10 | This Invention |
| (106) | (F) | 118 | 0.09 | This Invention |
| (107) | (G) | 115 | 0.09 | This Invention |
| (108) | (H) | 150 | 0.28 | Comparative Example |
| (109) | (I) | 160 | 0.14 | This Invention |
| (110) | (J) | 171 | 0.12 | This Invention |
| (111) | (K) | 153 | 0.10 | This Invention |
| (112) | (L) | 115 | 0.08 | This Invention |
| (113) | (M) | 105 | 0.10 | This Invention |

Note: Sensitivity is a relative value assumed that of (A) as 100.

As is apparent from the results in Table 2, samples of the present invention (104) to (107) and (109) to (113) show a photographic property high in sensitivity and less in fogging.

EXAMPLE 2

Silver chlorobromide emulsions of cubic grain (N) to (V) were prepared by the same procedure, except that temperature and the amount of chemicals were changed as shown in Table 3.

Samples (201) to (203) having the following layer compositions were prepared by using these emulsions:

TABLE 3

| Emulsion | pH when grain was formed | Spectral sensitizing dye | Silver chloride (mol %) | Triethyl thiourea (mol)* | Thiosulfonic acid compound** (mol)* | Sulfinic acid compound** (mol)* | Average grain size (μm) | Deviation Coefficient | Remarks |
|---|---|---|---|---|---|---|---|---|---|
| (N) | 6.3 | (a) | 99.0 | $1 \times 10^{-5}$ | — | — | 0.92 | 0.07 | Comparative Example |
| (O) | 6.3 | (a) | 99.0 | $1 \times 10^{-5}$ | $8 \times 10^{-6}$ | $8 \times 10^{-6}$ | 0.92 | 0.07 | This Invention |
| (P) | 3.6 | (a) | 99.0 | $1 \times 10^{-5}$ | $8 \times 10^{-6}$ | $8 \times 10^{-6}$ | 0.92 | 0.07 | This Invention |
| (Q) | 6.3 | (b) | 98.5 | $3 \times 10^{-5}$ | — | — | 0.50 | 0.09 | Comparative Example |
| (R) | 6.3 | (b) | 98.5 | $3 \times 10^{-5}$ | $2 \times 10^{-5}$ | $2 \times 10^{-5}$ | 0.50 | 0.09 | This Invention |
| (S) | 3.6 | (b) | 98.5 | $3 \times 10^{-5}$ | $2 \times 10^{-5}$ | $2 \times 10^{-5}$ | 0.50 | 0.09 | This Invention |
| (T) | 6.3 | (c) | 98.0 | $2 \times 10^{-5}$ | — | — | 0.55 | 0.08 | Comparative Example |
| (U) | 6.3 | (c) | 98.0 | $2 \times 10^{-5}$ | $2 \times 10^{-5}$ | $2 \times 10^{-5}$ | 0.55 | 0.08 | This Invention |
| (V) | 3.6 | (c) | 98.0 | $2 \times 10^{-5}$ | $2 \times 10^{-5}$ | $2 \times 10^{-5}$ | 0.55 | 0.08 | This Invention |

Note:
*mol per mol of silver halide
**added at the time of chemical sensitization Spectral sensitizing dyes used are as follows:

(a) The same as in Example 1

(b)

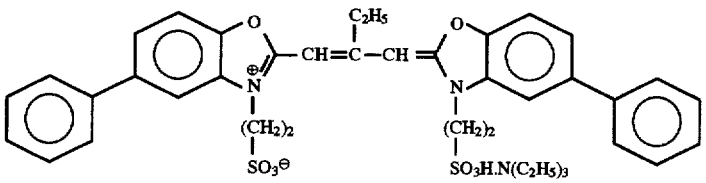

($4.0 \times 10^{-4}$ mol per mol of silver halide)

(c)

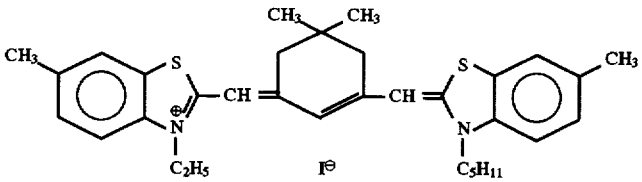

($0.9 \times 10^{-4}$ mol per mol of silver halide)

To the red-sensitive emulsion layer, the following compound was added in an amount of $2.6 \times 10^{-3}$ mol per mol of silver halide:

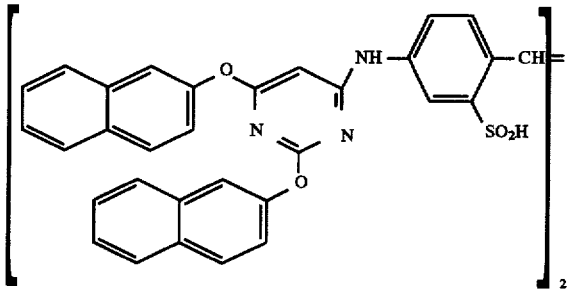

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.7 \times 10^{-4}$ mol, and $2.5 \times 10^{-4}$ mol, per mol of silver halide, respectively.

Further, to the blue-sensitive emulsion layer and the green-sensitive layer 4-hydroxy-6-methyl-1,3,3a,7-tetrazaubdebe was added in amounts of $1.0 \times 10^{-4}$ mol and $2.0 \times 10^{-4}$ mol per mol of silver halide, respectively.

The following dyes were added to the emulsion were to prevent irradiation.

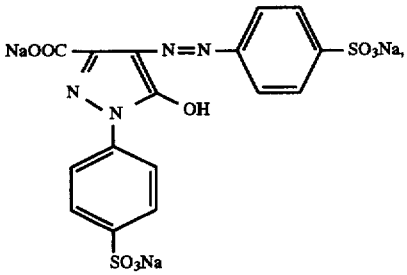

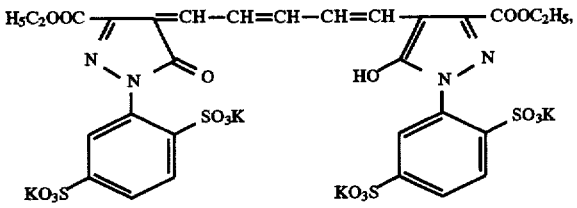

and

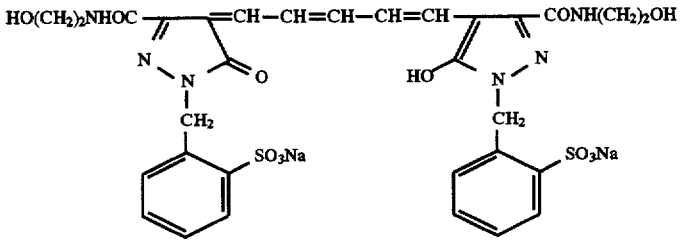

(Composition of Layers)

The composition of each layer is shown below. The figures represent coating amount ($g/m^2$). The coating amount of each silver halide emulsion is given in terms of silver.

Supporting Base

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer): | |
| The above-described silver chlorobroinide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsion | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |

-continued

| | |
|---|---|
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chloride emulsion | 0.23 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-l) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler
Mixture (1:1 in molar ratio) of
R = 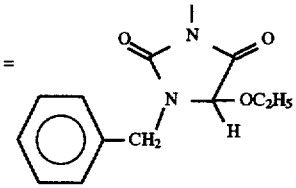 and R = 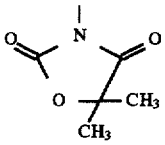
of the following formula
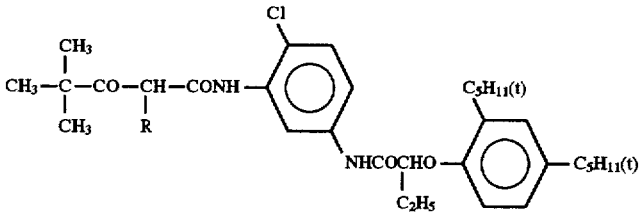
(ExM) Magenta coupler
Mixture (1:1 in molar ratio) of
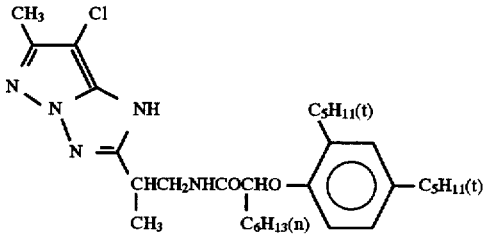
and
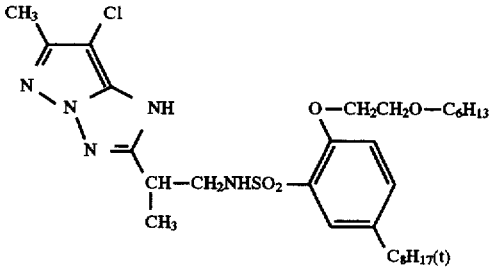
(ExC) Cyan coupler
Mixture (2:4:4 in weight ratio) of R = $C_2H_5$ and $C_4H_9$ of
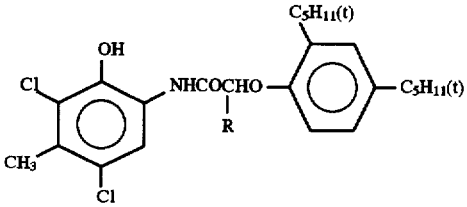
and
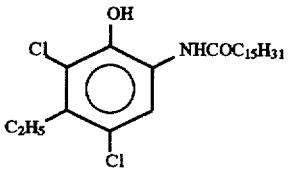
(Cpd-1) Image-dye stabilizer
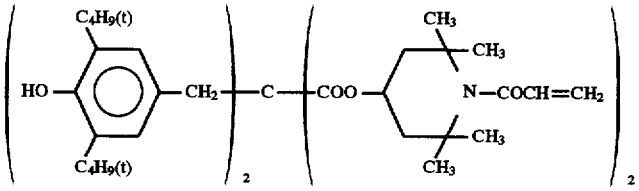

(Cpd-2) Image-dye stabilizer
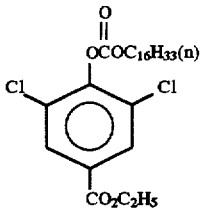
-continued
(Cpd-3) Image-dye stabilizer
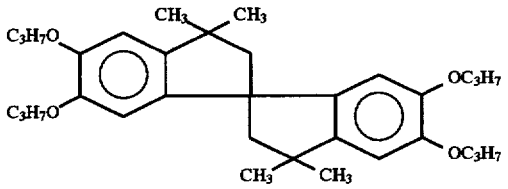
(Cpd-4) Image-dye stabilizer
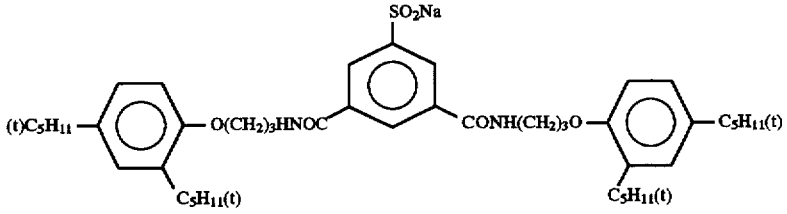
(Cpd-5) Color-mix inhibitor
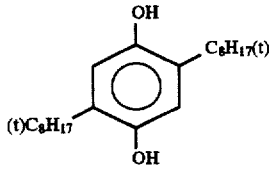
(Cpd-6) Image-dye stabilizer
Mixture (2:4:4 in weight ratio) of
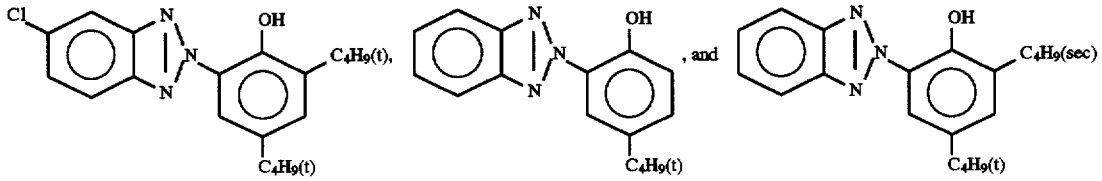
(Cpd-7) Image-dye stabilizer
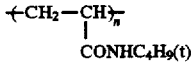
Average molecular weight: 60,000
(Cpd-8) Image-dye stabilizer
Mixture (1:1:1 in weight ratio) of
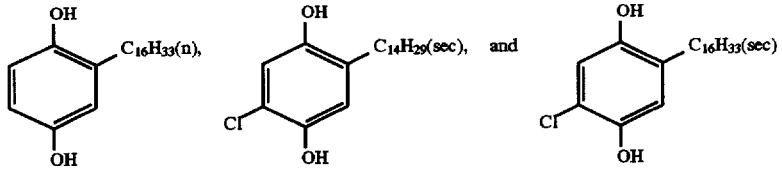
(Cpd-9) Image-dye stabilizer
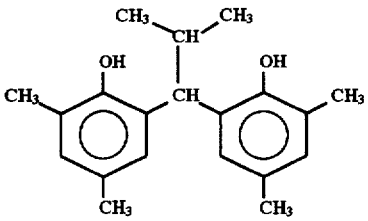

-continued (UV-1) Ultraviolet ray absorber
Mixture (4:2:4 in weight ratio) of

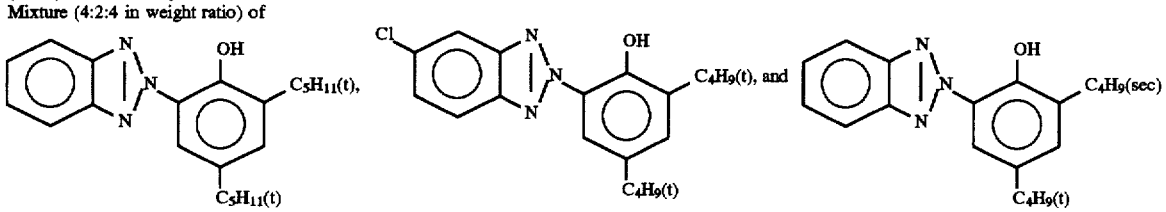

(Solv-1) Solvent

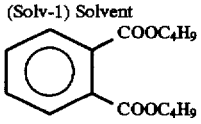

(Solv-2) Solvent
Mixture (2:1 in volume ratio) of

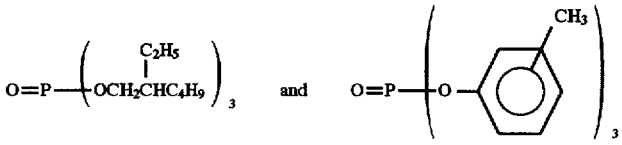

(Solv-4) Solvent

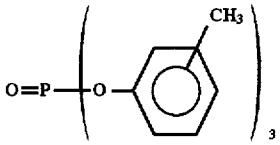

(Solv-5) Solvent

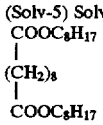

(Solv-6) Solvent

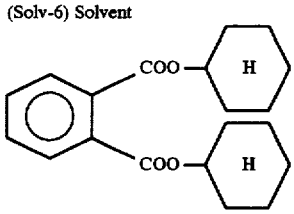

As gelatin-hardener sodium salt of 1-oxy-3,5-dichloro-s-triazine was used.

Each sample was subjected to an exposure to light according to the procedure in Example 1. After exposure to light, each sample was subjected to a continuous processing (running test) of the same processing steps as in Example 1 using a paper processor until the replenishing amount of color developer reached 2 times as much as tank volume.

Sensitivities and foggings of blue-sensitive layer, green-sensitive layer, and red-sensitive layer are shown in Table 4.

TABLE 4

| Sample | Photo-sensitive layer | Emul-sion | Sensi-tivity | Fogging | Remarks |
|---|---|---|---|---|---|
| (201) | Blue | (N) | 100 | 0.20 | Comparative Example |
| | Green | (Q) | 100 | 0.18 | Comparative Example |
| | Red | (T) | 100 | 0.18 | Comparative Example |
| (202) | Blue | (O) | 110 | 0.11 | This Invention |
| | Green | (R) | 116 | 0.11 | This Invention |
| | Red | (U) | 118 | 0.10 | This Invention |
| (203) | Blue | (P) | 115 | 0.09 | This Invention |
| | Green | (S) | 118 | 0.08 | This Invention |
| | Red | (S) | 118 | 0.09 | This Invention |

Note:
Sensitivity is a relative value assumed that of (N), (Q), and (T), as 100, respectively.

As is apparent from the results in Table 4, samples of the present invention (202) and (203), in comparison with comparative samples, show a photographic property high in sensitivity and less in fogging.

EXAMPLE 3

The same silver chlorobromide emulsion as in Example 1 was allowed to stand for 8 hours at 40° C. to give a lapse of time after dissolution, and then coated in the same manner as in Example 1 to prepare samples (301) to (313). Exposure to light and processing of samples were carried out in the same manner as Example 1. Results are shown in Table 5.

As is apparent from the results in Table 5, samples of the present invention (304) to (307) and (309) to (313) show a photographic property that the change of sensitivity upon the lapse of time after dissolution of coating sloution and the change of fogging are little.

TABLE 5

| Sample | Emulsion | Change of Sensitivity | Change of Fogging | Remarks |
|---|---|---|---|---|
| (301) | (A) | +15 | +0.09 | Comparative Example |
| (302) | (B) | +14 | +0.07 | Comparative Example |
| (303) | (C) | +14 | +0.07 | Comparative Example |

TABLE 5-continued

| Sample | Emulsion | Change of Sensitivity | Change of Fogging | Remarks |
|---|---|---|---|---|
| (304) | (D) | +2 | +0.01 | This Invention |
| (305) | (E) | 0 | 0 | This Invention |
| (306) | (F) | 0 | 0 | This Inventioh |
| (307) | (G) | +2 | 0 | This Invention |
| (308) | (H) | −10 | +0.15 | Comparative Example |
| (309) | (I) | −2 | +0.02 | This Invention |
| (310) | (J) | 0 | +0.01 | This Invention |
| (311) | (K) | −2 | 0 | This Invention |
| (312) | (L) | 0 | +0.01 | This Invention |
| (313) | (M) | +4 | +0.02 | This Invention |

Having described our invention as related to the embodiment, it is our intention that the invention be not limited by any of the details of the description, unless otherwise specified, but rather be construed broadly within its spirit and scope as set out in the accompanying claims.

What we claimed is:

1. A method for forming a silver chlorobromide emulsion or silver chloride emulsion having a silver chloride content of 95 mol % or more, comprising setting pH at grain formation of silver chlorobromide or silver chloride in a range of 3.0 to 5.5, and adding a thiosulfonic acid compound of formula (I) below and a sulfinic acid compound of Formula (II) below, each in an amount of $1\times10^{-6}$ to $3\times10^{-4}$ mol per mol of silver halide during production of a silver chlorobromide emulsion or silver chloride emulsion, followed by sulfur sensitization employing a thiourea as a sulfur sensitizer:

$$R^1—SO_2S—M_1 \quad \text{Formula (I)}$$

$$R^2—SO_2—M_2 \quad \text{Formula (II)}$$

wherein $R^1$ and $R^2$ each represent an aliphatic group, aromatic group, or heterocyclic group, and $M_1$ and $M_2$ each represents a cation.

2. A method according to claim 1, wherein the silver chlorobromide emulsion or silver chloride emulsion has a silver chloride content of 95 mol % or more, and is further subjected to gold sensitization.

3. A method according to claim 1, wherein the silver chloride content of silver chlorobromide emulsion is 98 mol % or more.

4. A method according to claim 1, wherein the silver chlorobromide emulsion or silver chloride emulsion is free from silver iodide.

5. A method according to claim 1, wherein the cation represented by $M_1$ in Formula (I) and $M_2$ in Formula (II) is selected from the group consisting of alkali metal ions and ammonium ions.

6. A method according to claim 1, wherein the thiosulfonic acid compound represented by Formula (I) and the sulfinic acid compound represented by Formula (II) are dissolved into water or an organic solvent or mixture thereof and then added to an aqueous solution of hydrophilic colloid for preparation of silver halide emulsion.

7. A method for forming a silver chlorobromide emulsion or silver chloride emulsion having a silver chloride content of 95 mol % or more, comprising setting pH at grain formation of silver chlorobromide or silver chloride in a range of 3.0 to 5.5, and adding a thiosulfonic acid compound of Formula (I) below and a sulfinic acid compound of Formula (II) below, each in an amount of $1\times10^{-6}$ to $3\times10^{-4}$ mol per mol of silver halide during production of a silver chlorobromide emulsion or silver chloride emulsion, followed by a combination of sulfur and selenium sensitization:

$$R^1—SO_2S—M_1 \quad \text{Formula (I)}$$

$$R^2—SO_2—M_2 \quad \text{Formula (II)}$$

wherein $R^1$ and $R^2$ each represent an aliphatic group, aromatic group, or heterocyclic group, and $M_1$ and $M_2$ each represents a cation.

8. A method according to claim 7, wherein the silver chlorobromide emulsion or silver chloride emulsion has a silver chloride content of 95 mol % or more, and is further subjected to gold sensitization.

9. A method according to claim 7, wherein the silver chloride content of silver chlorobromide emulsion is 98 mol % or more.

10. A method according to claim 7, wherein the silver chlorobromide emulsion or silver chloride emulsion is free from silver iodide.

11. A method according to claim 7, wherein the cation represented by $M_1$ in Formula (I) and $M_2$ in Formula (II) is selected from the group consisting of alkali metal ions and ammonium ions.

12. A method according to claim 7, wherein the thiosulfonic acid compound represented by Formula (I) and the sulfinic acid compound represented by Formula (II) are dissolved into water or an organic solvent or mixture thereof and then added to an aqueous solution of hydrophilic colloid for preparation of silver halide emulsion.

* * * * *